US008136916B2

(12) United States Patent
Nemoto et al.

(10) Patent No.: US 8,136,916 B2
(45) Date of Patent: Mar. 20, 2012

(54) IMAGE FORMING APPARATUS

(75) Inventors: Yusuke Nemoto, Atsugi (JP); Yoshihiko Kudoh, Sendai (JP); Akira Saito, Kakuda (JP); Yoshiyuki Shishido, Kakuda (JP); Yukitaka Watarai, Miyagi (JP); Hiroyuki Hiratsuka, Kakuda (JP); Susumu Shirauchi, Miyagi (JP); Shin-ichi Shoji, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 530 days.

(21) Appl. No.: 12/354,267

(22) Filed: Jan. 15, 2009

(65) Prior Publication Data

US 2009/0179928 A1 Jul. 16, 2009

(30) Foreign Application Priority Data

Jan. 15, 2008 (JP) ..... 2008-006258

(51) Int. Cl.
*B41J 2/165* (2006.01)
*B41J 23/00* (2006.01)
*B41J 2/155* (2006.01)

(52) U.S. Cl. ..... 347/22; 347/37; 347/42

(58) Field of Classification Search ..... 347/13, 347/22, 23, 29–34, 42, 101, 104, 37
See application file for complete search history.

(56) References Cited

U.S. PATENT DOCUMENTS

| | | | | |
|---|---|---|---|---|
| 5,760,802 | A * | 6/1998 | Ebinuma et al. | 347/33 |
| 2005/0212838 | A1 * | 9/2005 | Nakashima | 347/8 |

FOREIGN PATENT DOCUMENTS

| | | | |
|---|---|---|---|
| JP | 3-243356 | | 10/1991 |
| JP | 11-105376 | | 4/1999 |
| JP | 3025110 | | 1/2000 |
| JP | 2002-59559 | | 2/2002 |
| JP | 2002-059559 | * | 2/2002 |
| JP | 2003-11377 | | 1/2003 |
| JP | 2005-138371 | | 6/2005 |
| JP | 4187772 | | 9/2008 |

* cited by examiner

*Primary Examiner* — Geoffrey Mruk
(74) *Attorney, Agent, or Firm* — Cooper & Dunham LLP

(57) ABSTRACT

An image-forming apparatus includes a head unit configured to include line-type recording heads for ejecting ink droplets, a transport mechanism disposed facing the recording head and configured to transport a sheet, a maintain-recovery mechanism disposed downstream from the transport mechanism in a direction in which the sheet is transported and configured to maintain and recover the line type recording heads, and a head drive mechanism configured to move the head unit between a position facing the transport mechanism and a position facing the maintain-recovery mechanism in the direction in which the sheet is transported.

12 Claims, 9 Drawing Sheets

IMAGE FORMING APPARATUS

CROSS-REFERENCE TO RELATED APPLICATIONS

This patent specification claims priority from Japanese Patent Application No. 2008-006258, filed on Jan. 15, 2008 in the Japan Patent Office, the entire contents of which is hereby incorporated by reference herein.

BACKGROUND

1. Technical Field

This disclosure relates to an image-forming apparatus, and more particularly, to an image-forming apparatus that is equipped with a recording head for ejecting ink droplets and a transport belt for transporting sheets of recording media onto which the ink droplets are ejected to form an image.

2. Discussion of the Background

As an image-forming apparatus, such as a printer, a facsimile machine, a plotter, or a multifunction machine including at least two of these functions, a liquid-ejecting image-forming apparatus such as an inkjet recording device that uses a recording head for ejecting ink droplets is known.

There are two types of the liquid-ejecting image-forming apparatuses. A serial-type image-forming apparatus forms images using a recording head that ejects ink droplets while moving in a main scanning direction. By contrast, a line-type image-forming apparatus forms images using a recording head that remains stationary while ejecting ink droplets.

In either case, the liquid-ejecting image-forming apparatus forms images by ejecting the ink droplets from the recording head onto a sheet of recording media while the sheet is being transported. Therefore, the transport characteristics of the image-forming apparatus profoundly affect imaging performance.

Such a liquid-ejecting image-forming apparatus is equipped with a maintenance-recovery mechanism that performs maintenance and recovery, in other words cleaning, of a recording head for ejecting the ink droplets.

The maintenance-recovery mechanism for the recording head generally includes a moisturizing cap, a suction cap, wiper members, wiper cleaners, and an idle ejection receiver.

The moisturizing cap seals a nozzle surface of the recording head so as to keep the nozzle surface moist and prevent it from drying out.

The suction cap is connected to a suction mechanism, such as a suction pump, that suctions and discharges ink the viscosity of which has increased from the nozzle. It is to be noted that the moisturizing cap may serve as the suction cap as well.

The wiping members (wiper, wiper blade) wipe and remove any ink adhering to the nozzle surface. The wiper cleaner cleans the wiper. The idle ejection receiver receives the ink droplets that are ejected in an idle ejection that is a clearing operation and do not contribute to forming images.

Such cleaning is performed in various ways. Thus, for example, in one known liquid-ejecting image-forming apparatus, a head unit containing the recording head pivots to an upright position, after which the head unit slides to a position facing a maintenance-recovery unit so as to be cleaned.

In another known liquid-ejecting image-forming apparatus, even during printing, in order to cap a head unit that is not in use, a maintenance-recovery unit is disposed downstream from the head unit in a direction in which a recording media is transported.

Additionally, a known liquid-ejecting image-forming apparatus includes a transport unit to transport sheets using a transport belt, an image-recording unit such as a recording head that is equipped with several ink-ejecting ports aligned in the same direction as a direction in which the transport unit transports the sheets, and a release mechanism that switches the transport unit between an image-recording state and a release state to facilitate removal of a jammed sheet.

In the image-recording state, the transport unit can transport the sheets close to the ink ejecting ports. In the release state, the transport unit is disengaged from all ink releasing ports and is almost parallel to or inclined with respect to the image-recording unit.

As a separate matter, it is to be noted that when a liquid-ejecting image-forming apparatus forms images, a gap between a reading head and a surface of the sheet must be kept constant, that is, maintained at a predetermined or given distance. Therefore, a distance between the recording head and a surface of the transport belt is generally adjusted according to a thickness of a sheet of recording media used in an image forming operation.

Thus, in another known liquid-ejecting image-forming apparatus, the head unit is mounted on a sliding device that includes a vertically moving mechanism, and a surface position of a recording media is detected so that the gap is adjusted to a predetermined or given distance.

As an additional complication, in the above-described image-forming apparatus, line-type recording head units are widely used in order to improve a printing speed. A known line-type recording head unit includes nozzle lines each of which extends in an entire width of the sheet. In another known line-type recording head unit, each nozzle line is formed by multiple recording heads arranged to extend in an entire width of the sheet.

In order to maintain and recover such line-type recording heads, generally, configurations like those described below are adopted.

In one configuration, both multiple line-type recording heads and maintenance-recovery mechanisms (maintenance mechanisms or cleaning mechanisms) are arranged in alternating rows in a direction in which the sheet is transported, and the line-type recording heads and maintenance-recovery mechanisms move repeatedly relative to each other in both horizontally and vertically to carry out the cleaning of the recording heads.

However, such a configuration is relatively complicated. Moreover, in the above-described configuration, the distance between the multiple line type recording heads is longer, and accordingly, color deviation, which means that the different color ink droplets are not properly aligned in a multicolor image on the sheet, is likely to occur.

In another configuration, the maintenance-recovery mechanism is located in the shoulder of sheet transport route, which is out of the sheet transport route in a direction orthogonal to the sheet transport route, and the line type recording head rotates to the maintenance-recover mechanism.

However, in this configuration, a depth of the image-forming apparatus is relatively long.

BRIEF SUMMARY

In an aspect of this disclosure, there is provided an image-forming apparatus that includes a head unit configured to include line type recording heads for ejecting ink droplets, a transport mechanism disposed facing the recording head and configured to transport a sheet, a maintain-recovery mechanism disposed downstream from the transport mechanism in a direction in which the sheet is transported and configured to maintain and recover the line type recording heads, and a head moving mechanism configured to move the head unit, between a position facing the transport mechanism and a position facing the maintain-recovery mechanism, in the direction in which the sheet is transported.

BRIEF DESCRIPTION OF THE DRAWINGS

The aforementioned and other aspects, features and advantages would be better understood by reference to the following detailed description when considered in connection with the accompanying drawings, wherein.

DETAILED DESCRIPTION OF PREFERRED EMBODIMENTS

Figure 1:
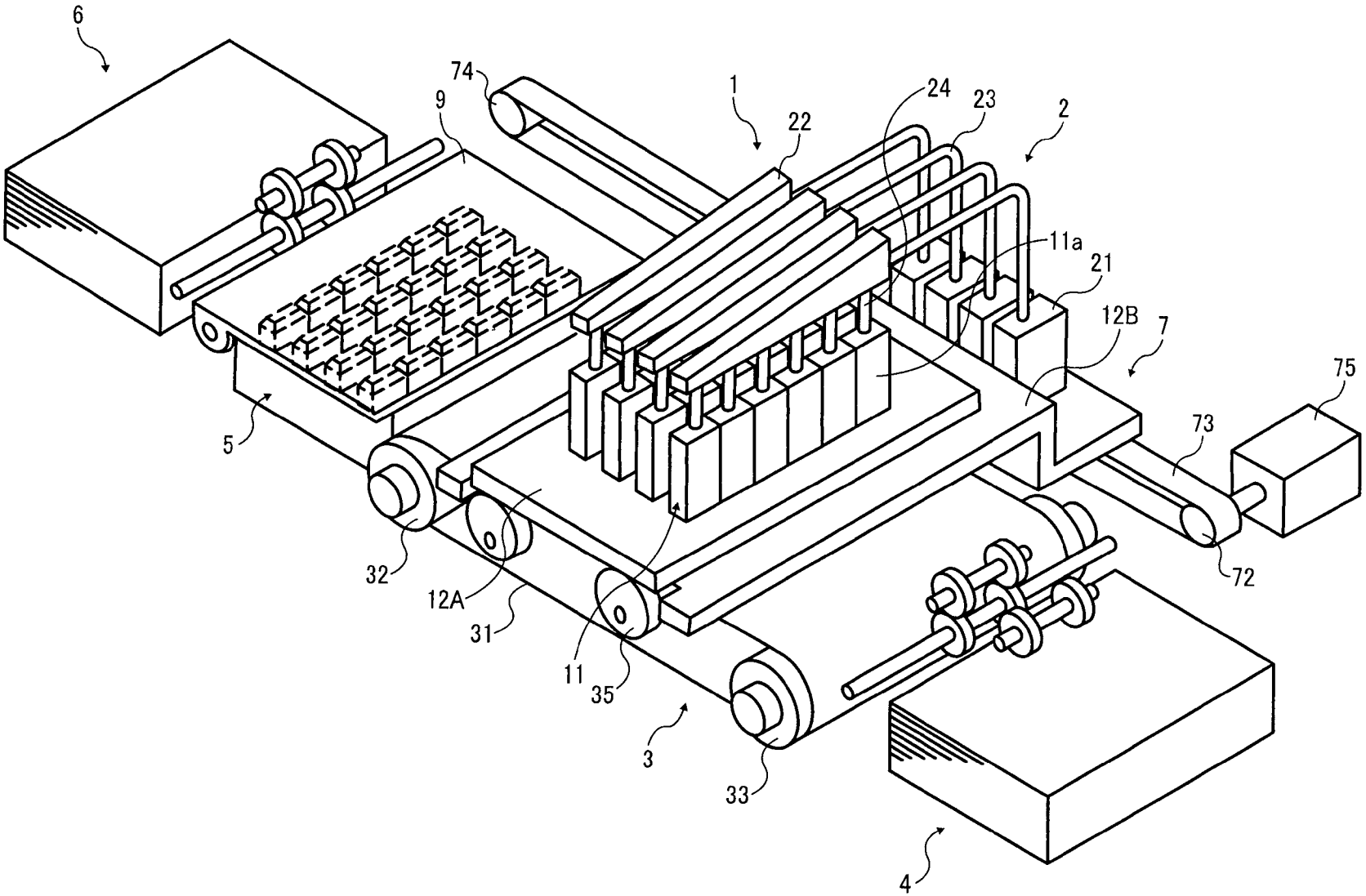
FIG. 1 is a schematic perspective view illustrating an overall configuration of an image-forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

It is to be noted that, in the present application, "image-forming apparatus" means the device that ejects the ink to a recording media, such as paper, thread, fiber, textile, metal, plastic, glass, ceramic, etc., so as to form images thereon, and "image forming" includes both forming on the recording media an image including a pattern, etc., that has no commonly understood meaning as well as image including a letter and/or an illustration that does have a given meaning. Further, "ink" is not limited to only the materials generally called "ink" but also used as a generic term for the liquid, such as recording-liquid, fixing liquid, other liquid, etc., that can form images.

Moreover, "transfer sheet" includes not only paper but also any materials to which ink can adhere, such as an overhead projector (OHP) sheet, textile, etc., and is used as a generic term for all types of recording medium, recording paper, a recording sheet, etc.

Figure 2:
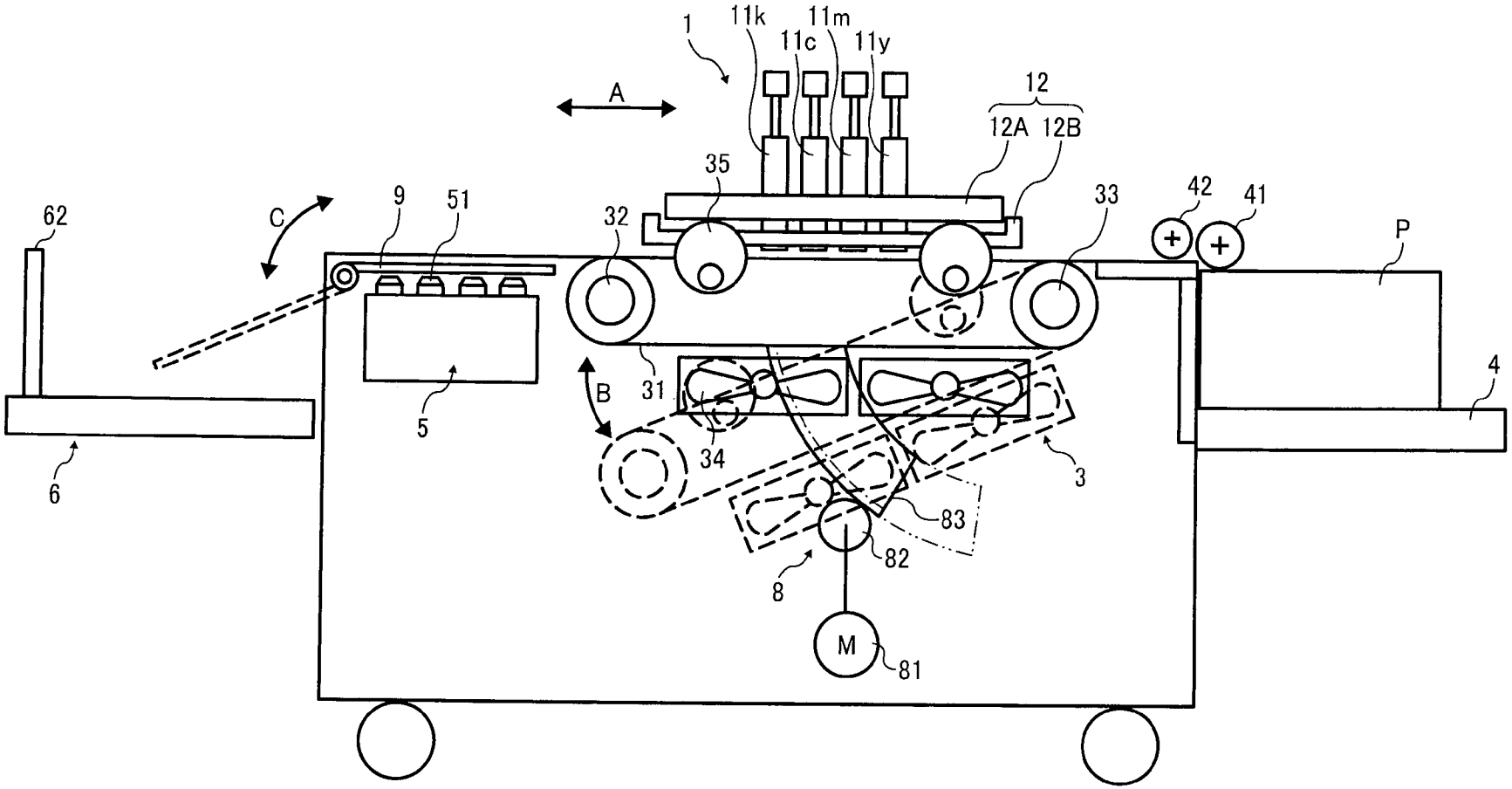
FIG. 2 is a schematic side view illustrating an overall configuration of the image-forming apparatus shown in FIG. 1.
Figure 3:
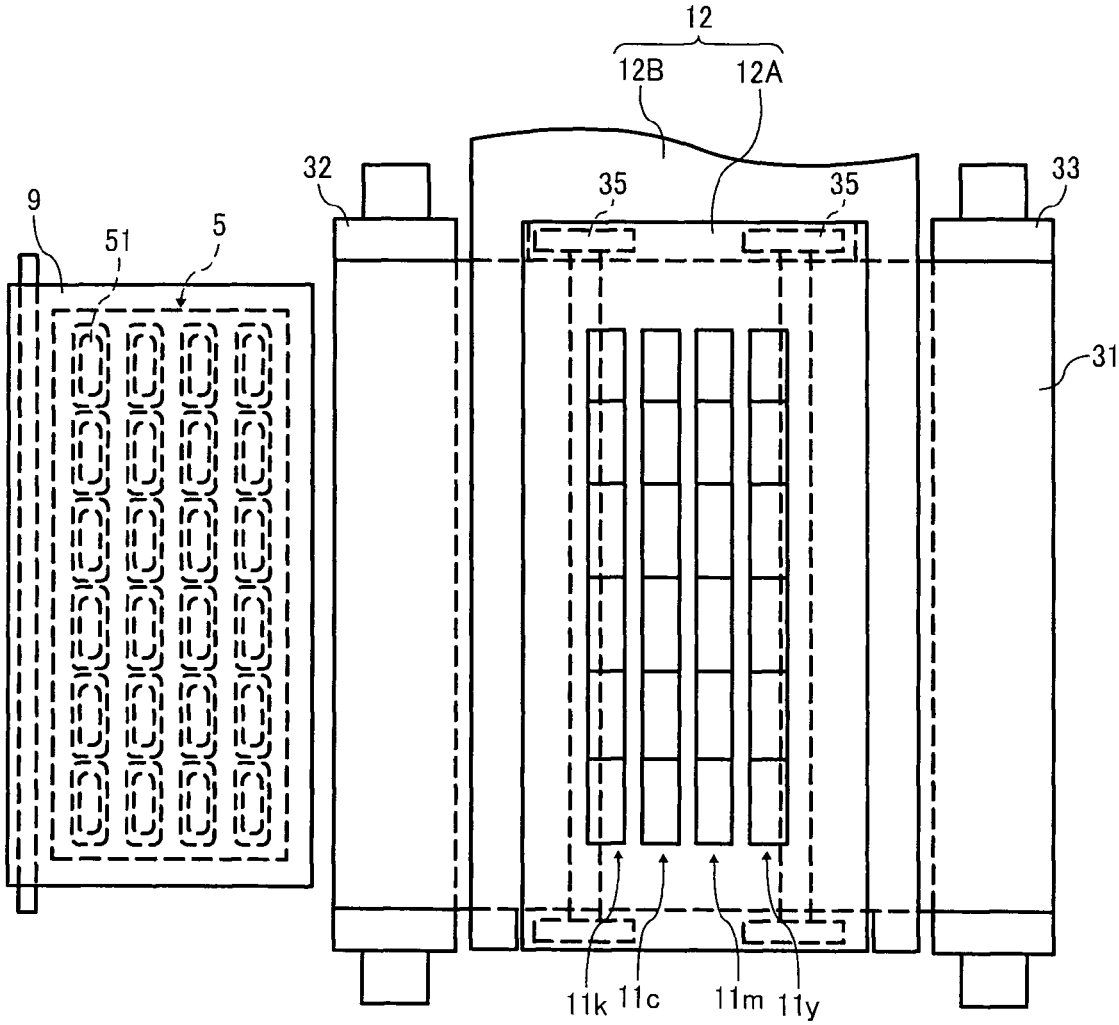
FIG. 3 is a plan view illustrating a main part of the image-forming apparatus shown in FIG. 1.

Referring now to the drawings, wherein like reference numerals designate identical or corresponding parts throughout the several views thereof, and particularly to FIGS. 1 through 3, an image-forming apparatus according to an illustrative embodiment of the present invention is described.

FIG. 1 is a schematic perspective side view illustrating an overall configuration of the image-forming apparatus, FIG. 2 is a schematic side view illustrating an overall configuration of the image-forming apparatus, and FIG. 3 is a plan view illustrating a main part of the image-forming apparatus shown in FIGS. 1 and 2.

Referring to FIGS. 1 and 2, it can be seen that the image-forming apparatus includes a head unit 1, an ink supply device 2, a transport unit 3, a sheet feeder 4, a maintenance-recovery (cleaning) unit 5, a discharge tray 6, and a head drive unit 7.

The head unit 1 includes line type recording heads 11 (11*k*, 11*c*, 11*m*, and 11*y*) that eject ink droplets. The ink supply device 2 supplies the ink to the recording heads 11 in the head unit 1. The transport unit 3 is disposed facing the recording heads 11 in the head unit 1 and transports a sheet P. The sheet feeder 4 feeds the sheet P to the transport unit 3.

The maintenance-recovery unit 5 maintains and recovers, that is, cleans, the line type recording heads 11 in the head unit 1. The sheet P is discharged onto the discharge tray 6. The head drive unit 7 moves the head unit 1 between a position facing the transport unit 3 and a position facing the maintenance-recovery unit 5 in a direction indicated by arrow A shown in FIG. 2, in which the sheet P is transported.

Referring to FIGS. 2 and 3, in the head unit 1, the four recording heads 11*y*, 11*m*, 11*c*, and 11*k* are arranged in parallel in the direction in which the sheet P is transported (hereinafter "sheet transport direction") and held in a base member 12.

The multiple recording heads 11*y*, 11*m*, 11*c*, and 11*k* eject yellow, magenta, cyan, and black liquid ink, respectively, and include multiple heads 11*a*, shown in FIG. 1, for ejecting ink droplets.

It is to be noted that the subscripts Y, M, C, and K attached to each reference numeral indicate only that components indicated thereby are used for forming yellow, magenta, cyan, and black images, respectively, and hereinafter may be omitted when color discrimination is not necessary.

Referring to FIG. 1, the ink supply device 2 is equipped with a main tank unit, not shown, that includes replaceable main tanks (ink cartridges) storing respective color ink, sub-tanks (ink tanks) 21 that are supplied with the ink from the main tanks, and branching portions 22 that supply the ink supplied from the sub-tanks 21 via supply tubes 23 to the heads 11*a* via supply tubes 24, respectively.

It is to be noted that, because the sub-tanks 21 are located at a position lower than that of the recording heads 11 in the head unit 1 so as to balance the force of the ink dripping down from the recording heads 11 and the force of the ink returning to the sub-tanks 21 through the ink supply tubes 24, a required negative pressure is generated in the recording heads 11.

The head unit 1 is held in a base member assembly 12 that consists of a first base member 12A and a second base member 12B. The first base member 12A holds the head unit 1, and the second base member 12B holds the first base member 12A movably at least in a vertical direction. Further, the sub-tanks 21 of the ink supply unit 2 and the branching portions 22 are mounted on the second base member 12B.

Further, the second base member 12B is connected to a timing belt 73 that is wound around a driving roller 72 and a driven roller 74 of the head drive unit 7.

As the driving roller 72 rotates, driven by a driving motor 75, the driven roller 74 is rotated, and thus the timing belt 73 is rotated. Therefore, the second base member 12B moves in the sheet transport direction.

Thus, the head unit 1 moves between the position facing the transport unit 3 and the position facing the maintenance-recovery unit 5 in the sheet transport direction indicated by arrow A shown in FIG. 2.

In this way, because the head unit 1 and the sub-tank 21 of the ink supply unit 2 are held on the base member assembly 12, and more specifically, the second base member 12B, and are moved together therewith, the image-forming apparatus can prevent changes in the pressure in the supply tubes 23 and 24, which connect the sub-tanks 21 to the recording heads 11, caused by deformation of the supply tubes 23 and 24 as the head unit 1 and the sub-tank 21 of the ink supply unit 2 move together with the second base member 12B of the base member assembly 12. The ability to maintain a constant pressure in the supply tubes 23 and 24 is important to maintaining consistent imaging quality.

It is to be noted that, alternatively, when the image-forming apparatus adopts a method of directly supplying ink from the ink cartridges to the recording heads instead of via the above-described sub-tank ink supply method, the ink cartridge itself can be mounted directly on the second base member 12B.

Referring to FIG. 2, it can be seen that the transport unit 3 is equipped with a transport belt 31, a transport-driving roller 32, a transport driven roller 33, a suction fan 34 disposed beneath the transport belt 31, and a gap control unit 35.

The transport belt 31 disposed facing the head unit 1 transports the sheet P that is fed by a separation roller 41 and a feed roller 42 one by one. The transport belt 31 is an endless belt wound around the transport-driving roller 32 and the transport driven roller 33. As the transport-driving roller 32 rotates, driven by a belt driving motor, not shown, the driven roller 33 is rotated, and thus the transport belt 31 is rotated.

Multiple suction holes, not shown, for attracting the sheet P to the transport belt 31 by sucking air therethrough are formed on a surface of the transport belt 31 so that the transport belt 31 can transport the sheet P.

The suction fan 34 sucks air through the suction holes on the transport belt 31 to create a vacuum that attracts the sheet P to the transport belt 31 and holds it there.

It is to be noted that attraction of the sheet P is not limited to air suction creating a vacuum, and alternatively, the sheet can be attracted to the transport belt 61 using other methods such as electrostatic attraction, adhesion, etc.

The gap control unit 35 controls a gap between a nozzle surface of each recording head 11 in the head unit 1 and the surface of the transport belt 31, that is, the sheet transport surface.

The transport unit 3 can pivot on the driven roller 33 in a direction indicated by arrow B shown in FIG. 2 so as to move between a home position and a release position.

The home position, which herein is also called a first position, is close to the recording units 11, and is indicated by solid lines shown in FIG. 2.

The release position, which herein is also called a second position, is removed from the recording units 11, and is indicated by broken lines shown in FIG. 2. At the release position, the driving motor 32 disposed on a downstream side is at a lower position than that of the driven motor 33 disposed on an upstream side in the sheet transport direction.

Thus, the transport belt 31, the suction fan 34, the gap control unit 35 etc., are pivotable as a single integrated assembly between these two positions.

When the transport unit 3 is at the home position, the sheet P can be transported, and the head unit 1 can perform printing.

On the other hand, when the transport unit 3 is at the release position, a sheet that is jammed in the transport unit 3 can be removed. That is, because a downstream portion of the transport unit 3 in the sheet transport direction pivotally moves down when the transport unit 3 moves to the release position, removing the jammed sheet is relatively easy. Further, the head unit 1 can prevent or reduce interference between the nozzle surface of the recording head 11 in the head unit 1 and the transport belt 3 when the head unit 1 slides to the side of the maintenance-recovery unit 5.

Referring to FIG. 2, the transport unit 3 is moved between the home position and the release position by a release mechanism 8. The release mechanism 8 includes a release mechanism driving motor 81 and a sector gear 83. Torque from the release mechanism driving motor 81 is transmitted to the sector gear 83 through a pinion 82.

The release mechanism driving motor 81 and the pinion 82 are fixed on a base of the image-forming apparatus, in other words, an apparatus frame, and the sector gear 83 is fixed on a unit frame, not shown, of the transport unit 3.

As the pinion 82 rotates, the sector gear 83 rotates, thereby enabling the transport unit 3 to pivot and change position.

It is to be noted that, although a timing belt, gears, etc., are used to transmit the rotation of the release mechanism driving motor 81 to the pinion 82, for simplicity those components are omitted from the drawings.

The maintenance-recovery unit 5 is equipped with a cap member 51 that caps the nozzle surfaces of the recording heads 11. Above the maintain-recovery unit 5, a transport guide member 9 that covers the maintenance-recovery unit 5 is disposed. The transport guide member 9 can be rotated in a direction indicated by arrow C shown in FIG. 2 so as to move between two positions, open and closed.

When the transport guide member 9 is at an open position indicated by broken lines shown in FIG. 2, a top of the maintenance-recovery unit 5 is exposed.

When the transport guide member 9 is at a closed position indicated by solid lines shown in FIG. 2, the transport guide member 9 guides the sheet P from the transport unit 3.

The sheet feeder 6 is equipped with an end fence 62 and a side fence, not shown.

Figure 4:
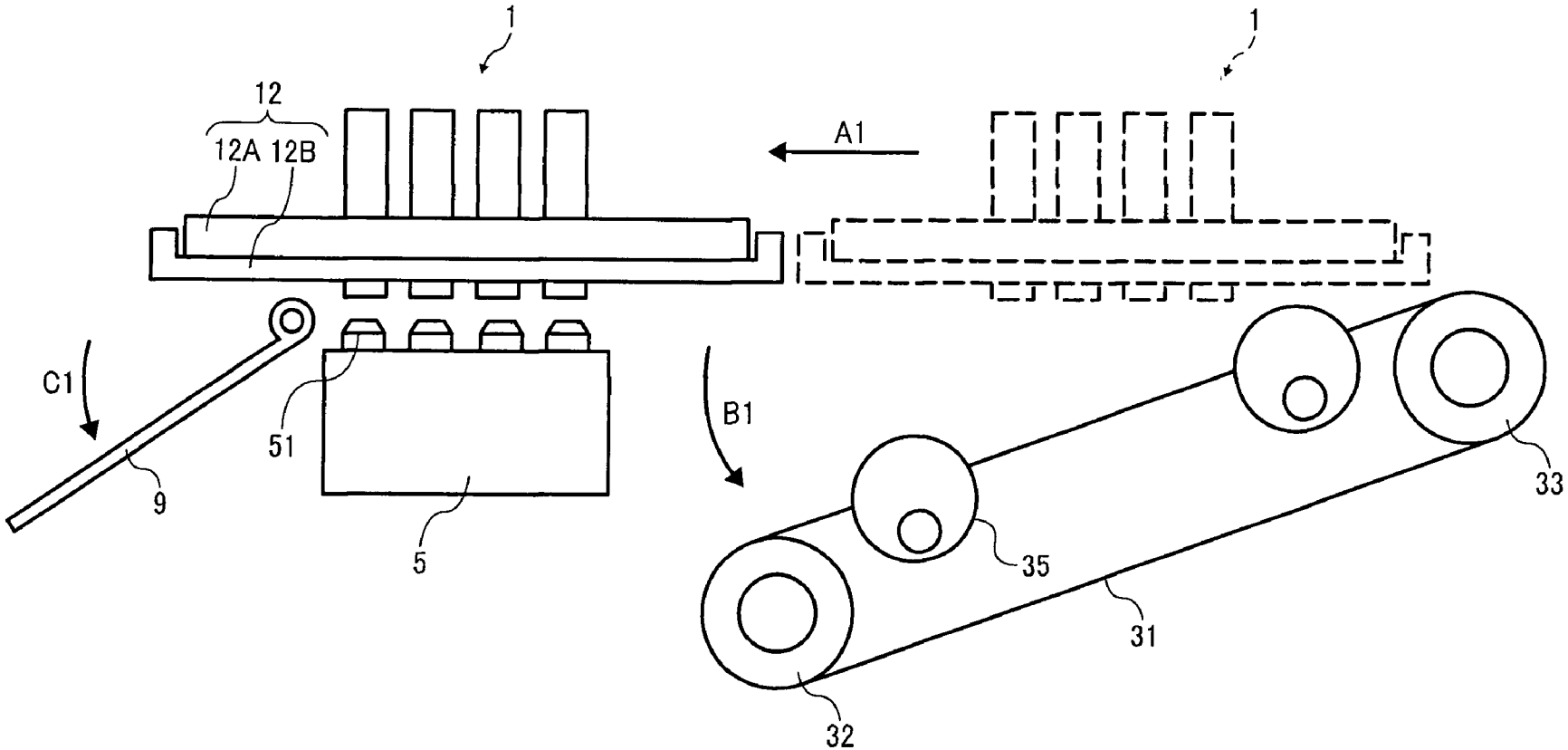
FIG. 4 is a schematic view illustrating a maintenance-recovery operation of the image-forming apparatus shown in FIG. 1.

Maintenance and recovery, that is, cleaning, of the recording heads 11 is described below with reference to FIG. 4.

First, as the transport unit 3 pivots to the release position in a direction indicated by arrow B1, the transport guide member 9 is rotated and opened in a direction indicated by arrow C1 so as to expose the top of the maintenance-recovery unit 5.

Subsequently, the driving motor 75 (shown in FIG. 1) in the head drive unit 7 moves the base member 12 so that the head unit 1 is slid with the base member 12 and stopped at a position above the maintenance-recovery unit 5.

After the cap member 51 caps the nozzle surfaces of the recording heads 11, a vacuum unit, not shown, cleans the recording heads 11 by sucking the ink therein from the nozzles through the cap member 51.

After the nozzle suction as the maintenance and recovery of the recording heads 11 is completed, the head unit 1 returns to the former position facing the transport unit 3 (printing position), and the transport guide member 9 is closed. Thereafter, the image-forming apparatus can perform printing.

As described above, the maintenance-recovery unit that maintains and recovers the line type recording heads is located downstream from the transport unit in the sheet transport direction, and the head unit is moved reciprocally in the sheet transport direction between the position facing the transport unit and the position facing the maintain-recovery unit.

As a result, cleaning of the head unit 1 can be performed by a relatively simple mechanism, minimizing depth of the image-forming apparatus.

Further, the recording heads can be arranged in parallel in the sheet transport direction at relatively short intervals, and therefore the distance between the respective colors decreases and thus reduces color deviation, which means that the different color ink droplets are not properly aligned in a multicolor image on the sheet. Thus, image quality can be improved.

Figure 5:
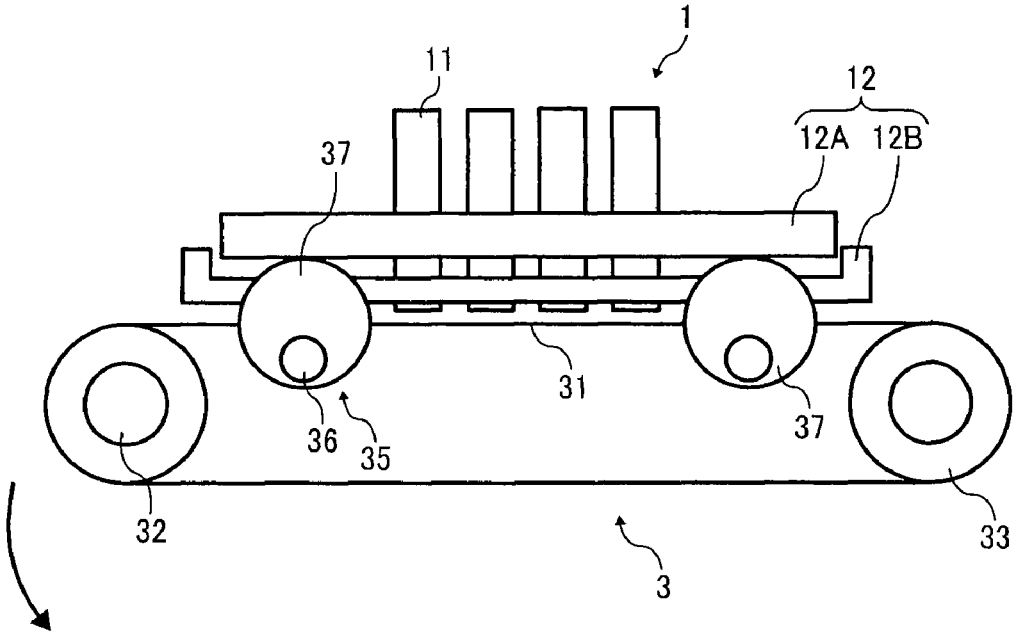
FIG. 5 is a schematic view illustrating a gap adjustment operation of the image-forming apparatus shown in FIG. 1.
Figure 6:
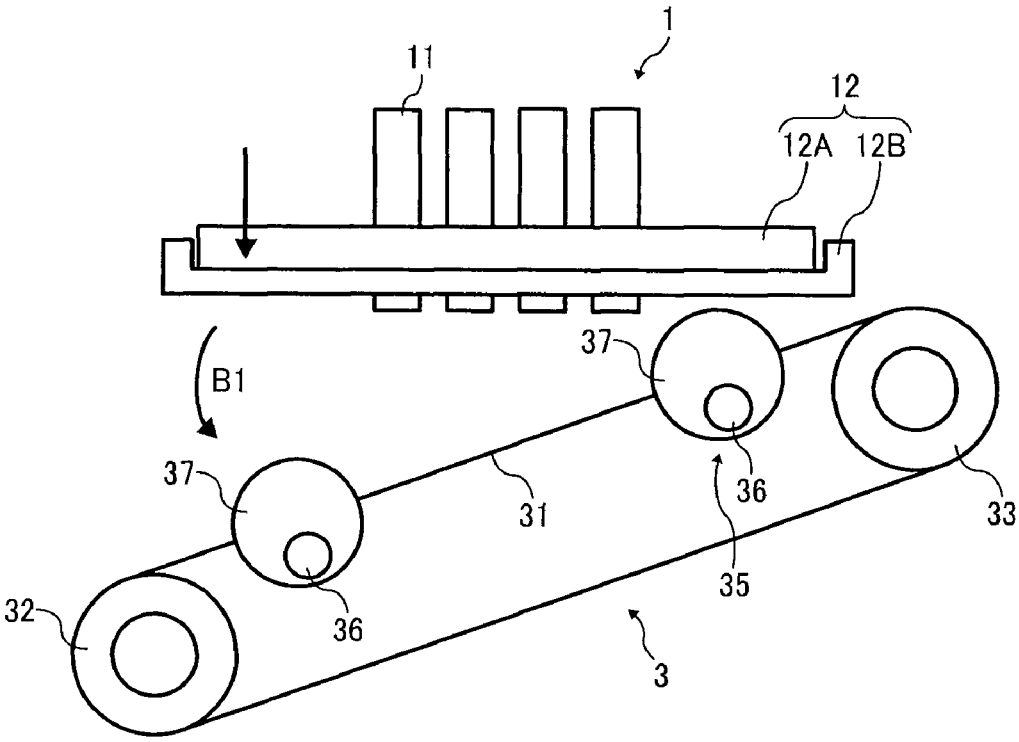
FIG. 6 is a schematic view illustrating a state in which the transport unit is at a release position and a gap control unit is disengaged therefrom.

Referring to FIGS. 5 and 6, gap adjustment in the image forming apparatus is described below.

The gap adjustment unit 35 includes an eccentric cam 37 attached to a rotary shaft 36 that is rotated by a driving motor, not shown. A rotational angular position of the eccentric cam 37 is detected by an encoder, not shown.

It is to be noted that, alternatively, the rotation angle can be controlled by a stepping motor.

Initially, referring to FIG. 5, when the transport unit 3 is at the home position, the eccentric cam 37 in the gap adjustment unit 35 touches the first base member 12A supporting the head unit 1 so that the first base member 12A is lifted higher than the second base member 12B.

Thus, a gap between the transport unit 3 and the nozzle surfaces of the recording heads 11 in the head unit 1 is set to a height that depends on a rotation position of the eccentric cam 37 in the gap adjustment unit 35.

By contrast, referring to FIG. 6, when the transport unit 3 is pivoted to the release position, the eccentric cam 37 in the gap adjustment unit 35 disengages from the first base member 12A in the head unit 1, and thus, the first base member 12A falls under its own weight.

Therefore, after the head unit 1 is cleaned, after which the head unit 1 is slid back to the position facing to the transport unit 3 as described above, by pivoting the transport unit 3 back to the home position, shown in FIG. 5, the gap between the head unit 1 and the transport unit 3 is automatically adjusted to the distance set by the rotation position of the eccentric cam 37 in the gap adjustment unit 35.

Figure 7:
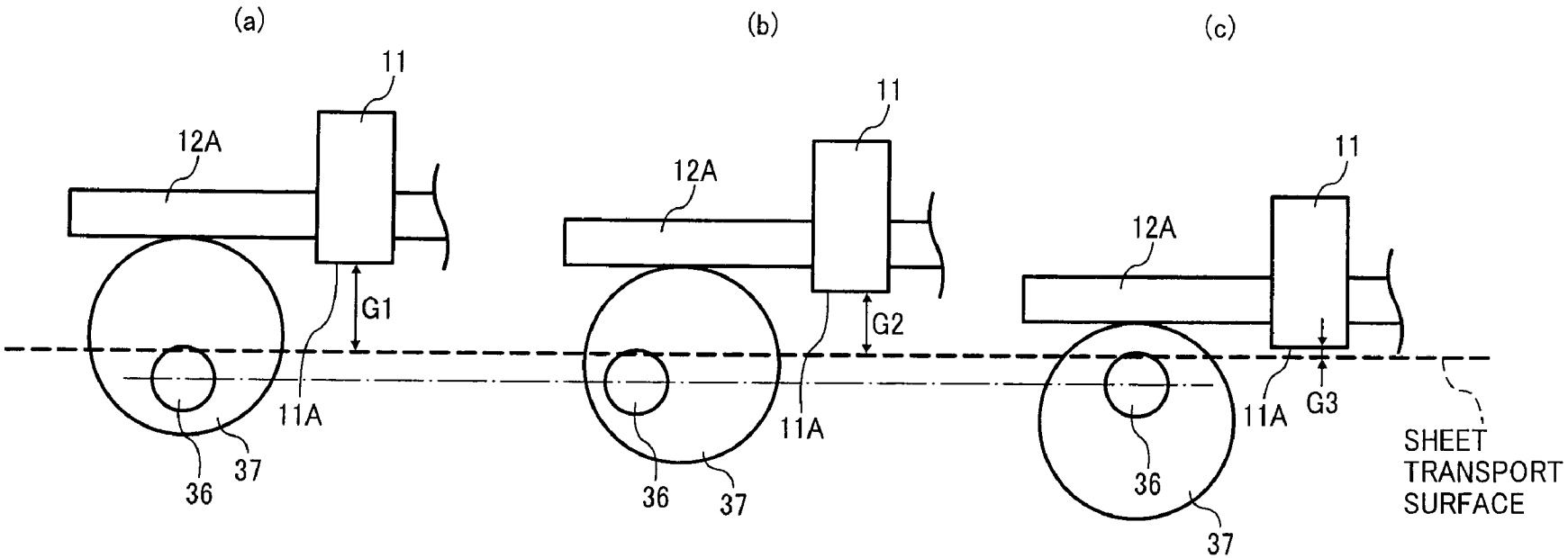
FIG. 7 is a schematic view illustrating gap adjustment of the image-forming apparatus shown in FIG. 1.

Referring to FIG. 7, because the eccentric cam 37 in the gap adjustment unit 35 is rotated around the rotary shaft 36, according to the rotation position of the eccentric cam 37, a gap G between the surface of the nozzle surface 11A and the sheet transport surface, that is, the surface of the transport belt 31, can be adjusted to a given distance.

It is to be noted that, (a), (b), and (c) in FIG. 7 show examples of the gap distance in a relation that can be expressed as G1>G2>G3.

Figure 8:
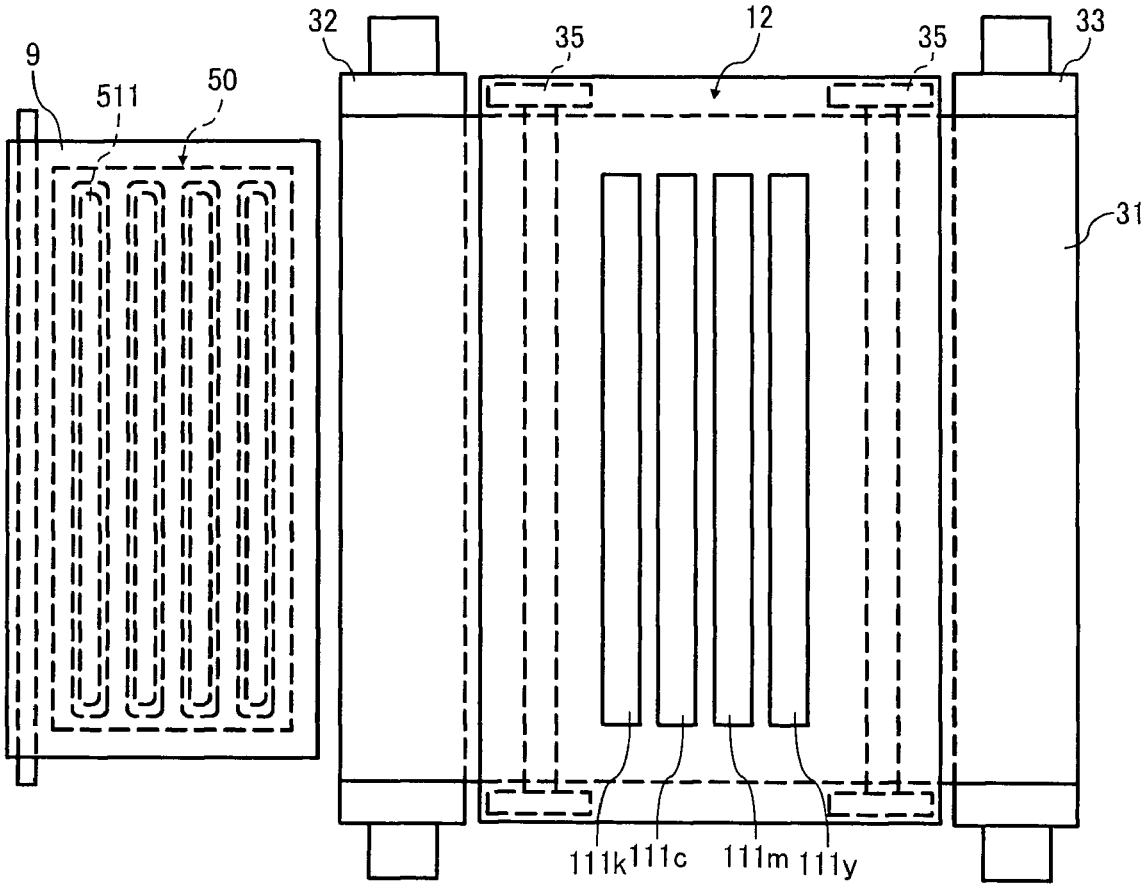
FIG. 8 is a plan view illustrating an image-forming apparatus according to another illustrative embodiment of the present invention.

Next, another embodiment of the present invention is described below, with reference to a plan view shown in FIG. 8. In the embodiment shown in FIG. 8, recording heads 111 (111*k*, 111*c*, 111*m*, and 111*y*) including nozzle lines extending an entire width of an image forming area are adopted. Accordingly, cap members 511 in a maintain-recovery unit 50 can accommodate the entire line corresponding to the recording heads 111. Other than that, the present embodiment has a configuration similar to that of the embodiment shown in FIGS. 1 through 7.

Figure 9:
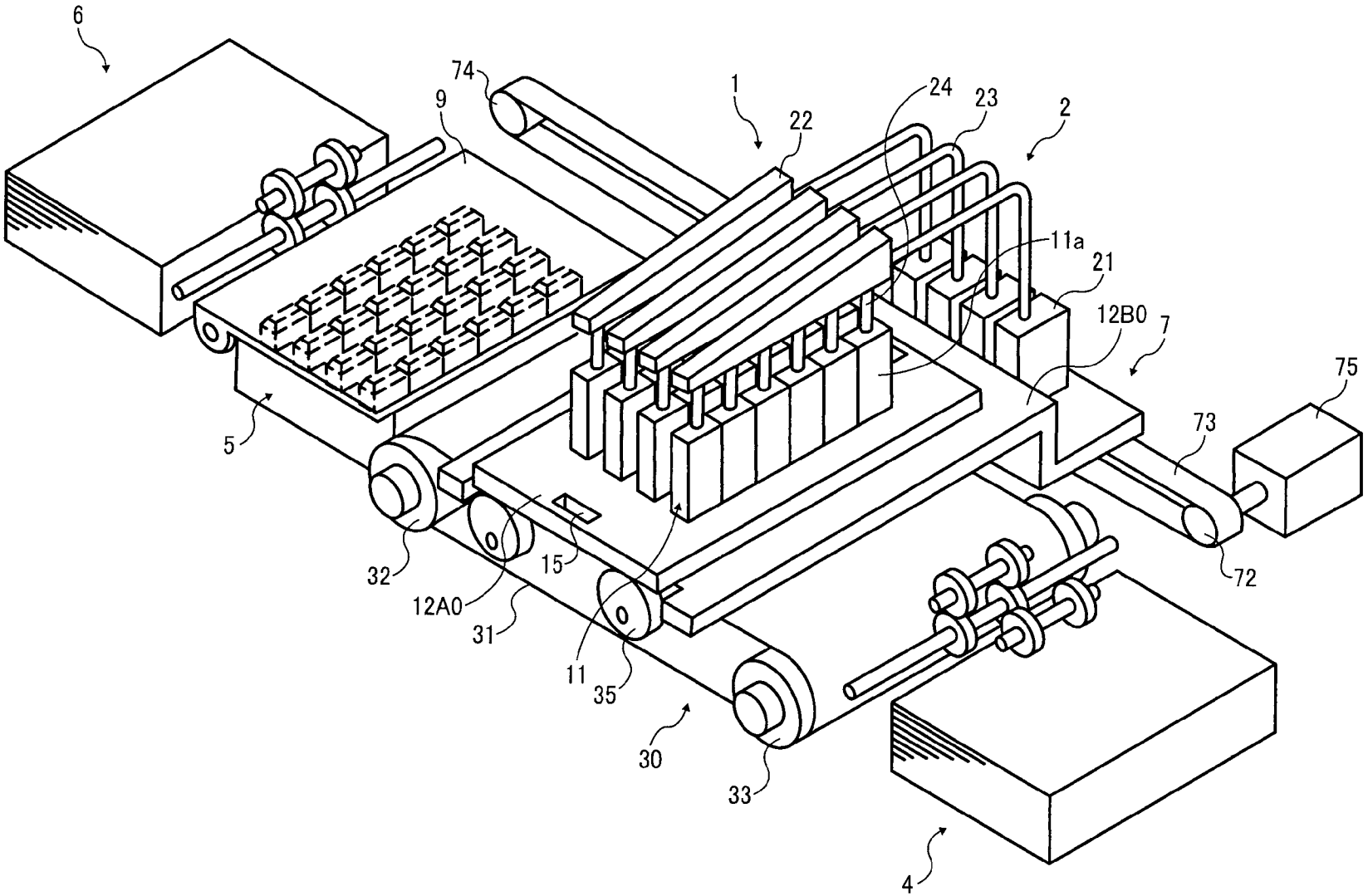
FIG. 9 is a schematic perspective side view illustrating an overall configuration of an image-forming apparatus according to another illustrative embodiment of the present invention.
Figure 10:
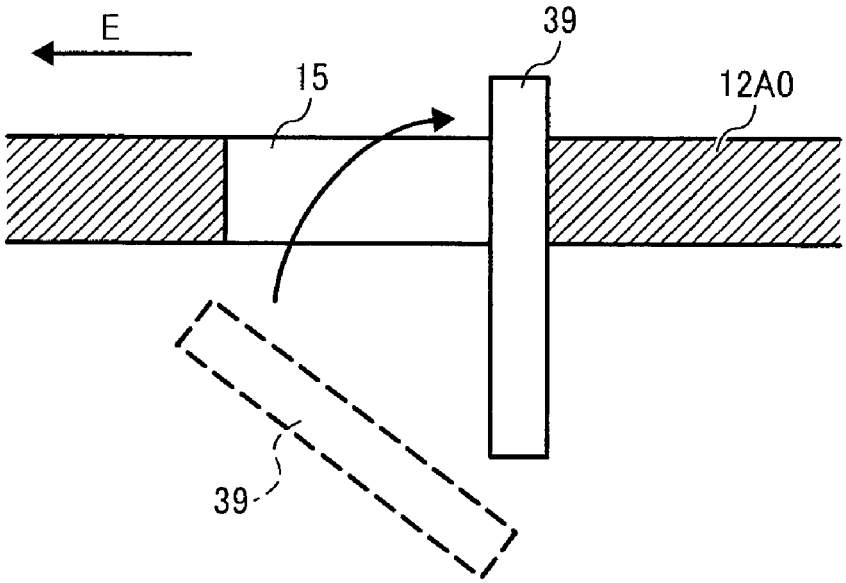
FIG. 10 is a cross-section view of a positioning portion of the image-forming apparatus shown in FIG. 9.
Figure 11:
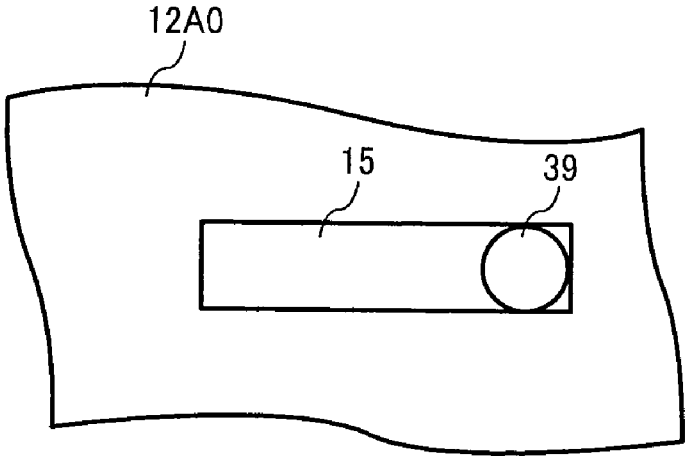
FIG. 11 is a plan view illustrating the positioning portion shown in FIG. 10.

Next, another embodiment of the present invention is describes, with reference to a schematic perspective side view illustrating an overall configuration shown in FIG. 9, a cross-sectional view shown in FIG. 10, and a plan view illustrating main elements shown in FIG. 11.

In the embodiment shown in FIGS. 9 through 11, a positioning hole 15 is disposed in a first base member 12A0 supporting a head unit 1 and a transport unit 30 is provided with a positioning pin 39 that can engage the positioning hole 15. The transport unit 30 is pivotable between a home position facing a transport belt 3 and a release position removed from the transport belt 3, in an arrangement similar to the transport unit 3 of the embodiment shown in FIGS. 1 through 7.

When the transport unit 30 pivots from the home position to the release position, respectively shown in FIGS. 10 and 11, the positioning pin 39 enters and engages the positioning hole 15, thereby defining the relative positions of the transport unit 3 and the head unit 1.

It is to be noted that the head unit 1 is urged by a spring, not shown, in a direction indicated by arrow E shown in FIG. 10. When the positioning pin 39 engages the positioning hole 15, as shown in FIGS. 10 and 11, the positioning pin 39 touches at least a side wall enclosing the positioning hole 15 on an upstream side in the direction indicated by arrow E. Other than that, the present embodiment has a configuration similar to that of the embodiment shown in FIGS. 1 through 7.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image-forming apparatus, comprising:

a head unit configured to include line-type recording heads for ejecting ink droplets;

a transport mechanism disposed facing the recording head and configured to transport a sheet;

a maintain-recovery mechanism disposed downstream from the transport mechanism in a direction in which the sheet is transported and configured to maintain and recover the line type recording heads;

a head drive mechanism configured to move the head unit between a position facing the transport mechanism and a position facing the maintain-recovery mechanism in the direction in which the sheet is transported;

a first base member configured to hold the head unit; and a second base member configured to hold the first base member movably at least in a vertical direction, wherein the transport mechanism is movable between a home position close to the recording head and a release position removed from the recording head, wherein the transport mechanism further comprises a gap control mechanism configured to control a size of a gap between a nozzle surface of the recording head in the head unit and a transport surface of the transport mechanism at the home position.

2. The image-forming apparatus according to claim 1, further comprising a transport guide member disposed above the maintenance-recovery mechanism and configured to be rotatable between an open position that exposes the maintain-recovery mechanism and a closed position that covers the maintain-recovery mechanism and guides the sheet.

3. The image-forming apparatus according to claim 2, wherein the transport mechanism comprises a transport belt that is wound around at least a first roller and a second roller, and the transport mechanism is pivotable between said home position and said release position about the first roller, the first roller being disposed upstream in the direction in which the sheet is transported.

4. The image-forming apparatus according to claim 1, wherein the transport mechanism comprises a transport belt is that is wound around a first roller and a second roller, and the transport mechanism is pivotable between the home position and the release position about the first roller, the first roller being disposed upstream in the direction in which the sheet is transported.

5. An image forming apparatus, comprising:

a head unit configured to include line-type recording heads for ejecting ink droplets;

a first base member configured to hold the head unit;

a second base member configured to hold the first base member movably at least in a vertical direction;

a transport mechanism disposed facing the recording head and configured to transport a sheet;

a maintain-recovery mechanism disposed downstream from the transport mechanism in a direction in which the sheet is transported and configured to maintain and recover the line type recording heads; and a head drive mechanism configured to move the head unit between a position facing the transport mechanism and a position facing the maintain-recovery mechanism in the direction in which the sheet is transported.

6. The image forming apparatus according to claim 5, wherein the head drive mechanism moves the head unit, the first base member and the second base member between the position facing the transport mechanism, and the position facing the maintain-recovery mechanism, in the direction in which the sheet is transported.

7. The image forming apparatus according to claim 5, wherein the transport mechanism is moveable between a home position close to the recording head and a release position relatively far, as compared to the home position, from the recording head.

8. The image forming apparatus according to claim 7, wherein when the transport mechanism is in the home position, the transport member contacts the first base member and causes the first base member and the head unit to move upward in the vertical direction and away from the second base member, and when the transport mechanism is in the release position, the transport member causes the first base member and the head unit to move downward in the vertical direction and toward the second base member.

9. The image forming apparatus according to claim 7, wherein the transport mechanism comprises a transport belt that is wound around at least two rollers, and the transport mechanism is pivotable between the home position and the release position about a roller disposed upstream in the direction in which the sheet is transported.

10. The image forming apparatus according to claim 7, wherein the transport mechanism further comprises a gap control mechanism configured to control a size of a gap between a nozzle surface of the recording head in the head unit and a transport surface of the transport mechanism at a home position.

11. The image forming apparatus according to claim 5, further comprising a transport guide member disposed above the maintenance-recovery mechanism and configured to be rotatable between an open position that exposes the maintain-recovery mechanism and a closed position that covers the maintain-recovery mechanism and guides the sheet.

12. An image forming apparatus, comprising:

a head unit configured to include line-type recording heads for ejecting ink droplets;

main tanks configured to store the ink;

sub-tanks supplied with the ink from the respective main tanks;

supply tubes through which the ink is supplied from the sub-tanks to the recording heads respectively;

a first base member configured to hold the head unit;

a second base member configured to hold the first base member and the sub-tanks;

a transport mechanism disposed facing the recording heads and configured to transport a sheet;

a maintain-recovery mechanism disposed downstream from the transport mechanism in a direction in which the sheet is transported and configured to maintain and recover the line type recording heads; and a head drive mechanism configured to move the head unit between a position facing the transport mechanism and a position facing the maintain-recovery mechanism in the direction in which the sheet is transported, and to cause the first base member to move with the second base member therebetween.

* * * * *